US010577549B2

(12) United States Patent
Cuoq et al.

(10) Patent No.: US 10,577,549 B2
(45) Date of Patent: Mar. 3, 2020

(54) N,N-DIMETHYLACETAMIDE AS WASH-OIL FOR DILUTION STEAM SYSTEMS

(71) Applicant: SABIC Global Technologies B.V., Bergen op Zoom (NL)

(72) Inventors: Fabrice Cuoq, Geleen (NL); Sasja Helsen, Geleen (NL); Carlo Geijselaers, Geleen (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/328,126

(22) PCT Filed: Aug. 21, 2017

(86) PCT No.: PCT/IB2017/055037

§ 371 (c)(1),
(2) Date: Feb. 25, 2019

(87) PCT Pub. No.: WO2018/037328

PCT Pub. Date: Mar. 1, 2018

(65) Prior Publication Data

US 2019/0185769 A1 Jun. 20, 2019

Related U.S. Application Data

(60) Provisional application No. 62/378,885, filed on Aug. 24, 2016.

(51) Int. Cl.

| | |
|---|---|
| ***C10G 75/04*** | (2006.01) |
| ***C10G 9/36*** | (2006.01) |
| ***C23G 5/036*** | (2006.01) |

(52) U.S. Cl.
CPC ..... *C10G 75/04* (2013.01); *C10G 9/36* (2013.01); *C23G 5/036* (2013.01); *C10G 2300/4075* (2013.01); *C10G 2300/44* (2013.01)

(58) Field of Classification Search
None
See application file for complete search history.

(56) References Cited

U.S. PATENT DOCUMENTS 3,016,985 A * 1/1962 Akin ..... C07C 7/11 95/186
3,769,217 A * 10/1973 Bannister et al. ..... C07C 7/08 203/53

(Continued)

FOREIGN PATENT DOCUMENTS

EP 1511072 A2 3/2005
EP 1897908 A1 3/2008

OTHER PUBLICATIONS

International Search Report and Written Opinion from PCT/IB2017/055037 dated Nov. 10, 2017, 9 pages.

(Continued)

*Primary Examiner* — Tam M Nguyen
(74) *Attorney, Agent, or Firm* — Norton Rose Fulbright US LLP

(57) ABSTRACT

A method of removing material that fouls processing equipment that includes applying a composition comprising N,N-dimethylacetamide (DMAC) to fouling material deposited on the processing equipment to solubilize and remove the fouling material from the processing equipment.

20 Claims, 4 Drawing Sheets

(56) References Cited

U.S. PATENT DOCUMENTS

| | | | | |
|---|---|---|---|---|
| 5,232,464 | A * | 8/1993 | Klezl | C10L 1/023 44/388 |
| 5,782,989 | A | 7/1998 | Rueter | 134/22.19 |
| 2003/0136727 | A1* | 7/2003 | Yamada | B01D 69/02 210/490 |
| 2007/0169667 | A1 | 7/2007 | Lu | 106/38.22 |
| 2010/0258504 | A1 | 10/2010 | Ab Wahid et al. | 210/650 |
| 2018/0257038 | A1* | 9/2018 | Ishii | B01D 65/08 |

OTHER PUBLICATIONS

Parsons et al. *Industrial Process Profiles for Environmental Use: Chapter 5—Basic Petrochemical Industry*. Industrial Environmental Research Laboratory, Office of Research and Development, U.S. Environmental Protection Agency, Research Triangle Park, North Carolina. Jan. 1977. 154 pages.

* cited by examiner

N,N-DIMETHYLACETAMIDE AS WASH-OIL FOR DILUTION STEAM SYSTEMS

CROSS-REFERENCE TO RELATED APPLICATIONS

This application is a national phase application under 35 U.S.C. § 371 of International Application No. PCT/IB2017/055037 filed Aug. 21, 2017, which claims priority to U.S. Provisional Patent Application No. 62/378,885 filed Aug. 24, 2016. The entire contents of each of the above-referenced disclosures is specifically incorporated by reference herein without disclaimer.

TECHNICAL FIELD

The present invention relates to resolving fouling in petroleum/petrochemical processing equipment. More specifically, the invention relates to the use of N,N-dimethylacetamide (DMAC) to remove material that fouls petroleum/petrochemical processing equipment.

BACKGROUND OF THE INVENTION

Fouling of processing equipment is inherent to some petrochemical processes. For example, dilution steam systems (DSSs) used in the production of ethylene can be subject to fouling. The dilution steam system of ethylene plants may include a quench water tower (QWT), quench water settler (QWS), process water stripper (PWS), and dilution steam generator (DSG). When this equipment is fouled, it affects the equipment's performance, which in turn affects overall plant efficiency and productivity.

The degree to which processing equipment is fouled relates to the process in which such equipment is used. For instance, the process for producing ethylene may involve steam cracking hydrocarbon feedstocks such as naphtha, ethane, and propane. In the steam cracking (pyrolysis) process, the hydrocarbons are superheated in a furnace to temperatures as high as 750-950° C. For the cracking process, the dilution steam generator supplies dilution steam to the reactor to reduce the partial pressure of the hydrocarbons. The superheated hydrocarbons are then rapidly cooled (quenched) to stop the reactions after a certain point (e.g., to prevent further cracking to methane). The quenching of the superheated gas in many processes is carried out using water in the quench water tower. The superheated cracked gas (including ethylene) is flowed into the bottom of the quench water tower and, at the same time, water is sprayed into the top of the quench water tower. As the water in the quench water tower falls, it makes contact with the upwardly flowing superheated cracked gas and, in that way, cools the superheated cracked gas (that includes ethylene) and dilution steam.

Because of the direct contact between the superheated cracked gas in the quench water tower and the condensation of the dilution steam, the water flowing from the quench water tower is mixed with condensed hydrocarbons (referred to as pyrolysis gasoline). Pyrolysis gasoline may include components such as aromatics, olefins, and diolefins, among others. In the quench water tower, the pyrolysis gasoline and water mixes to form an emulsion. Thus, the quench water tower effluent stream flowing from the bottom of the quench water tower includes an emulsion having a water phase and a hydrocarbon phase. The emulsion is particularly difficult to break. In other words, the emulsion is stable because, once the emulsion is formed, the water does not easily separate from the pyrolysis gasoline.

To facilitate the separation of the water from the pyrolysis gasoline, the quench water tower effluent stream is flowed from the quench water tower to the quench water settler. At the quench water settler, the quench water effluent stream (including the emulsion) is settled and water is drawn off from the bottom of the quench water settler. Then, the water from the quench water settler is sent to the process water stripper. The process water stripper strips the water of acid gases and dissolved hydrocarbons. After being stripped in the process water stripper, the water is routed to the dilution steam generator. The water that circulates from the dilution steam generator to the furnace, to the quench water tower, to the quench water settler, to the process water stripper, and back to the dilution steam generator is referred to as process water, which circulates in a quench water tower loop.

Because the emulsions in the quench water tower tend to be stable, the process water may carry a large amount of hydrocarbons to the process water stripper. These hydrocarbons can cause fouling of the process water stripper. The dilution steam generator may also foul because of hydrocarbon carry-over. Further, process water that flows from the bottom of the quench water tower and the quench water settler can contain traces of styrene as well as oligomers of styrene that form in the water as a result of the long residence time of the water recycle in the quench water tower loop. These oligomers grow further at process water stripper conditions and generally cause fouling in the dilution steam system.

Fouling materials usually have low thermal conductivity and, thus, are a major resistance to heat transfer in processing equipment. Consequently, fouling is of particular concern in heat exchange equipment. When heat exchangers foul, their heat exchanging capacity decreases.

Fouling at the bottom of the process water stripper and in the dilution steam generator preheaters can lead to poor energy efficiency and, in a worst case scenario, to a plant shutdown if excessive fouling sufficiently restricts flow of process water in the quench water tower loop. Fouling of the dilution steam generators can cause cycles of concentration of the dilution steam generator to be low (e.g., 4-5 cycles), which can cause water, energy, and/or chemical losses.

A common method of solving the fouling problem involves the use of emulsion breakers to improve pyrolysis gasoline/water separation in the quench water tower, or quench water settler, or both. Another method for solving the fouling problem is to inhibit polymerization within the quench water tower loop using stable free radical (SFR) type of inhibitors or anti-oxidant. This helps to inhibit the formation of oligomers and thus improves the quality of the water entering the dilution steam system. A further method for solving the fouling by hydrocarbons is to apply a dispersant in the process water stripper. However, this method has limited effect when the amount of hydrocarbons in the water is high. While these methods of preventing fouling are effective to varying degrees, they can be time consuming and/or costly to implement. Further, their efficiencies at removing or preventing fouling tend to be low.

BRIEF SUMMARY OF THE INVENTION

A discovery related to the aforementioned problems associated with fouling of petroleum/petrochemical processing equipment has been made. The discovery is premised on the use of a particular water-miscible organic compound that can act as an effective solvent for solubilizing and removing fouling material in petroleum/petrochemical processing plants. In particular, the present invention concerns the use of N,N-dimethylacetamide (DMAC) to solubilize and remove fouling material in processing equipment such as a dilution steam system. By way of example, fouling material in dilution steam systems (e.g. a dilution steam system of a liquid cracker) generally includes polystyrene and/or other aromatic fouling materials. The present invention is directed to systems and methods that use DMAC to remove fouling material (including polystyrene fouling material and/or other aromatic fouling materials) from equipment in petrochemical plants, such as a liquid cracker.

Embodiments of the invention include a method of removing material that fouls processing equipment. The method includes applying a wash composition comprising DMAC to fouling material deposited on the processing equipment to solubilize and remove the fouling material from the processing equipment.

Embodiments of the invention include a method of removing fouling material that involves polystyrene from a dilution steam system involved in the production of ethylene. The method includes intermittently applying a solution comprising 0.1 to 99 parts DMAC, 0.2 to 50 parts, 0.3 to 10 parts, preferably 0.5 to 5 parts DMAC, to 100 parts water by volume to fouling material that includes polystyrene deposited on equipment of the dilution steam system to solubilize and remove the fouling material from the equipment. In certain instances, intermittent application comprises substantially the same period of time between applications of the solution. In other aspects, intermittent can include application at different time intervals between applications of the solution.

The following includes definitions of various terms and phrases used throughout this specification.

The terms "foul" and "fouling" refer to a process of forming, adding, or depositing a layer of extraneous material (e.g., material comprising polystyrene) on the surface of equipment.

The phrase "fouling material" refers to a layer or deposit of extraneous material (e.g., material comprising polystyrene) on the surface of equipment.

The term "emulsion" encompasses systems having at least two phases, a continuous phase and a dispersed phase. By way of example, the continuous phase can be an aqueous phase such as water, and the dispersed phase can be an organic phase such as a hydrocarbon phase (i.e., a hydrocarbon-in-water emulsion). Alternatively, the continuous phase can be an organic phase such as a hydrocarbon phase, and the dispersed phase can be an aqueous phase such as water (i.e., a water-in-hydrocarbon emulsion). The continuous and dispersed phases are typical liquid phases.

The terms "about" or "approximately" are defined as being close to as understood by one of ordinary skill in the art. In one non-limiting embodiment the terms are defined to be within 110%, preferably, within 5%, more preferably, within 1%, and most preferably, within 0.5%.

The terms "wt. %", "vol. %" or "mol. %" refers to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, includes any measurable decrease or complete inhibition to achieve a desired result.

The term "effective," as that term is used in the specification and/or claims, means adequate to accomplish a desired, expected, or intended result.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of" or "consist of" particular ingredients, components, compositions, etc., disclosed throughout the specification.

In the context of the present application, 20 embodiments are now described. Embodiment 1 a method of removing material that fouls processing equipment. The method includes comprising applying a composition comprising N,N-dimethylacetamide (DMAC) to fouling material deposited on the processing equipment to solubilize and remove the fouling material from the processing equipment. Embodiment 2 is the method of embodiment 1, wherein the processing equipment is used in production of ethylene. Embodiment 3 is the method of any one of embodiments 1 and 2, wherein the fouling material comprises polystyrene or other aromatic fouling material. Embodiment 4 is the method of any one of embodiments 1 to 3, wherein the processing equipment comprises a dilution steam system used in production of ethylene. Embodiment 5 is the method of any one of embodiments 1 to 4, wherein the processing equipment is a quench water tower, a quench water settler, a quench water loop, a process water stripper, a heat exchanger, or a pump. Embodiment 6 is the method of any one of embodiments 1 to 5, further including the step of continuously or intermittently dosing the composition to a feed of the dilution steam system before applying the composition to the fouling material. Embodiment 7 is the method of any one of embodiments 1 to 6, wherein the composition is applied by flushing the processing equipment with the composition, spraying the processing equipment with the composition, brushing the processing equipment with the composition, or adding the composition to a dilution steam generator feed. Embodiment 8 is the method of embodiment 7, wherein the applying of the composition comprises spraying the composition on the fouling material. Embodiment 9 is the method of any one of embodiments 1 to 8, wherein the composition is applied to the processing equipment intermittently. Embodiment 10 is the method of embodiment 9, wherein intermittent application comprises substantially the same period of time between applications of the composition. Embodiment 11 is the method of any one of embodiments 9 to 10, wherein applying the composition intermittently includes the steps of applying the composition in a first cleaning process; monitoring a process parameter in a quench water tower loop of a dilution steam system in use for production of ethylene; and when a particular criterion is met regarding the monitored process parameter, applying the composition in a second cleaning process. Embodiment 12 is the method of embodiment 11, wherein the percentage of DMAC in the composition is varied depending on which equipment in the quench water tower loop the composition is being applied. Embodiment 13 is the method of any one of embodiments 11 to 12, wherein information from the monitoring of the process parameter is used to establish the percentage of DMAC in the composition. Embodiment 14 is the method of any one of embodiments 1 to 13, wherein the composition comprises 0.5 to 10 parts DMAC to 100 parts water by volume. Embodiment 15 is the method of embodiment 14, wherein the composition comprises 0.5 to 5 parts DMAC to 100 parts water by volume. Embodiment 16 is the method of any of embodiments 1 to 14, further including the step of, prior to applying the composition comprising DMAC, heating or cooling the processing equipment to a temperature effective for solubilization of the fouling material by the composition. Embodiment 17 is the method of any of embodiments 1 to 16, further comprising, prior to applying the composition comprising DMAC, heating the composition to a temperature effective for solubilization of the fouling material by the composition. Embodiment 18 is the method of any one of embodiments 1 to 17, further comprising implementing a mechanical action for removing unsolubilized material after some of the fouling material has been solubilized. Embodiment 19 is the method of embodiments 1 to 18, wherein the mechanical action comprises rodding, scraping, or power washing. Embodiment 20 is the method of any one of embodiments 1 to 19, wherein the applying of the composition comprises adding the composition to the dilution steam system.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Reference is now made to the following descriptions taken in conjunction with the accompanying drawings, in which.

DETAILED DESCRIPTION OF THE INVENTION

The processes described above in relation to the dilution steam system used in the production of ethylene may cause the process water in the quench water tower loop to be susceptible to contamination from materials originating from the bottom of the quench water tower such as pyrolysis gasoline, styrene, oligomers of styrene etc. Process water transports these materials to different equipment within the dilution steam system, where they are deposited on and thereby cause fouling of the equipment. Fouling material in dilution steam systems of ethylene plants generally includes polystyrene and/or other aromatic fouling materials.

Maintaining processing equipment at optimum operational capacities/efficiencies may require periodically removing fouling material from the equipment. Embodiments of the invention involve removing fouling material from processing equipment with compositions comprising DMAC ($CH_3C(O)N(CH_3)_2$). In the production of ethylene, embodiments of the invention are directed to intermittently using a composition comprising DMAC to remove fouling material from processing equipment in a dilution steam system. Such processing equipment may include quench water towers, quench water loops, quench water settlers, process water strippers, heat exchangers, and/or pumps.

Fouling material that forms in processing equipment of petrochemical plants, including dilution steam systems in ethylene plants, sometimes include polystyrene. Effective processes to clean such equipment may advantageously include processes that are effective in removing polystyrene. Embodiments of the invention involve removing fouling material comprising polystyrene from processing equipment by applying a composition that includes DMAC to the fouling material. In certain aspects, the composition that includes DMAC can be applied online (i.e., the processing equipment is in operation). The non-limiting data provided in the Examples illustrate the feasibility of the processes of the present invention (see, e.g., Examples 1 and 2 and FIGS. 1 and 2).

Figure 3:
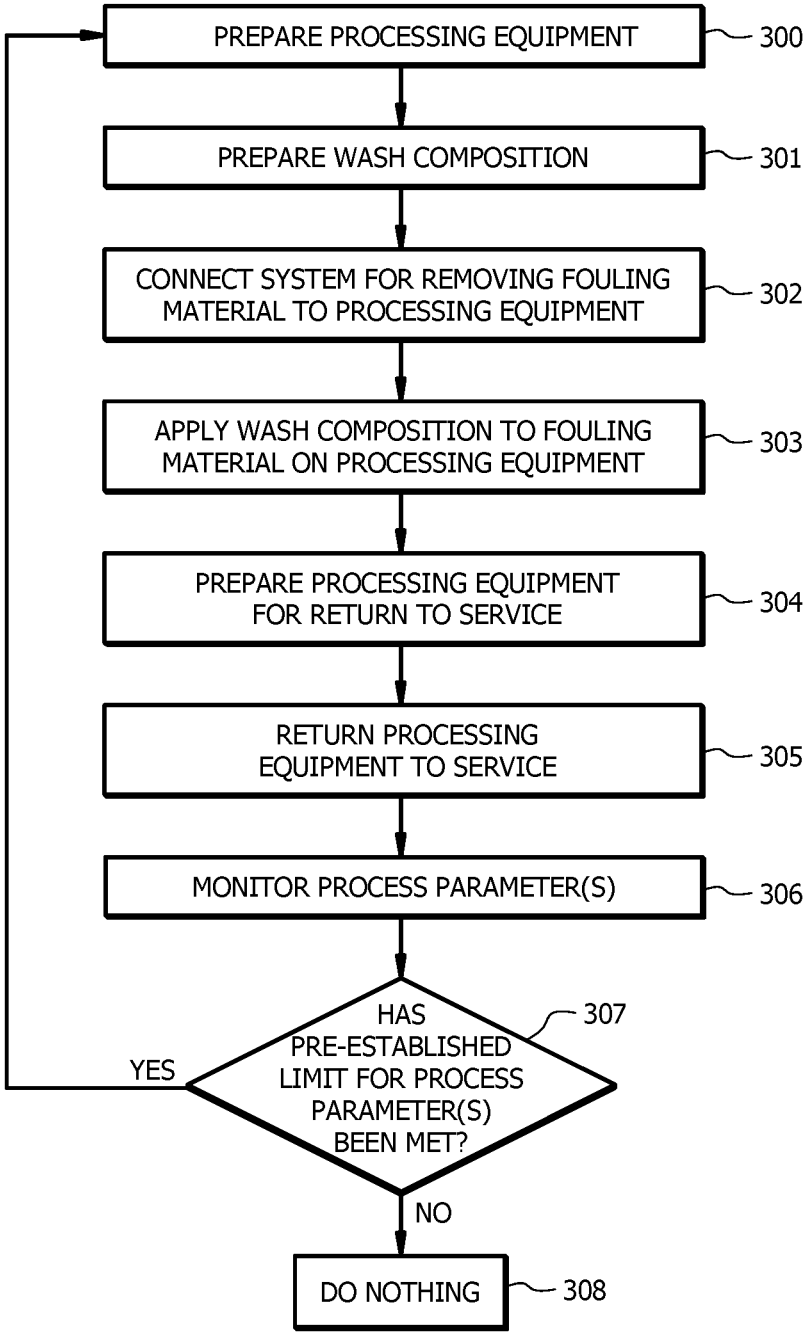
FIG. 3 shows a method for solubilizing fouling material, according to embodiments of the invention.
Figure 4:
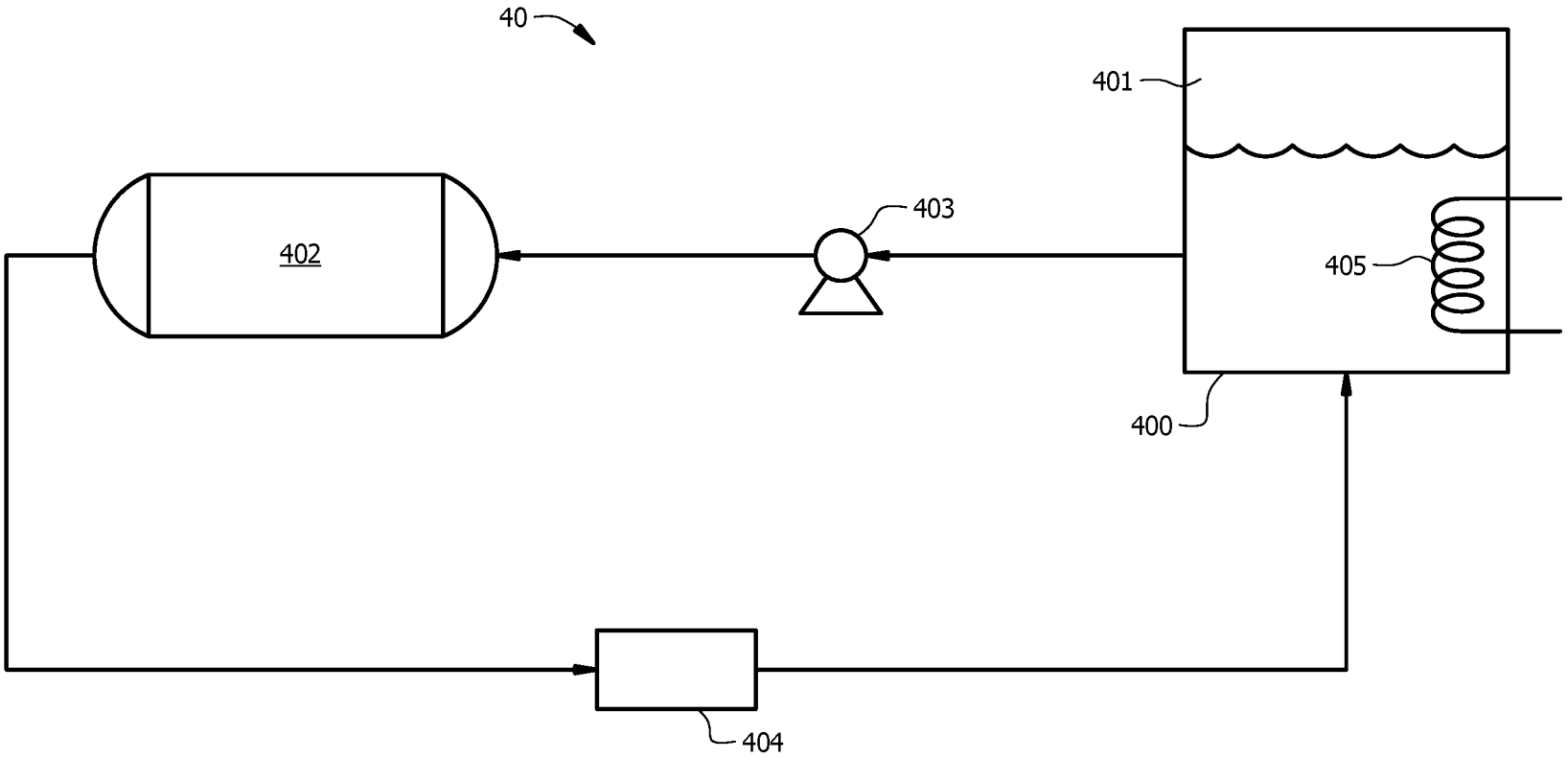
FIG. 4 shows a system for solubilizing fouling material, according to embodiments of the invention.

Referring to FIG. 3, a method 30 for removing fouling material from processing equipment according to embodiments of the invention is illustrated. FIG. 4 is a system for removing fouling material from processing equipment according to embodiments of the invention. Method 30 (a cleaning process) may be used, for example, to remove fouling material from heat exchanger 402 shown in system 40 of FIG. 4. Method 30 may begin, at block 300, by preparing the processing equipment to be cleaned of fouling material. For example, to clean heat exchanger 402, it may be disconnected from the system in which it is used, e.g. a dilution steam system of an ethylene plant.

Method 30 may also include preparing the DMAC composition to be used to remove the fouling material, as shown at block 301. Preparing the DMAC composition may include preparing it to have a particular concentration that is effective in removing the fouling material from heat exchanger 402. Generally the concentration that is effective may be dependent on the type of equipment on which the fouling material is deposited and/or the composition of the fouling material. In embodiments of the invention, composition 400 may include 0.1 to 5% vol. N,N-dimethylacetamide (DMAC), or 5 to 10% vol. DMAC, or 10 to 15% vol. DMAC, or 15 to 20% vol. DMAC, or 20 to 25% vol. DMAC, or 25 to 30% vol. DMAC, or 30 to 35% vol. DMAC, or 35 to 40% vol. DMAC, or 40 to 45% vol. DMAC, or 45 to 50% vol. DMAC, or 55 to 60% vol. DMAC, or 60 to 65% vol. DMAC, or 65 to 70% vol. DMAC, or 70 to 75% vol. DMAC, or 75 to 80% vol. DMAC, or 80 to 85% vol. DMAC, or 85 to 90% vol. DMAC, or 90 to 95% vol. DMAC, or 95 to 100% vol. DMAC or 1 to 100% vol. of DMAC, or 1 to 50% vol.

DMAC, or 1 to 25% vol. DMAC, or 1 to 10% vol. DMAC. Other components in the foregoing compositions 400 of DMAC may include water. For example, for other components of the compositions 400, water may be the other primary component or the only other component. It should be noted that the concentration of DMAC used in removing fouling material may depend on the processing equipment that is fouled, how the DMAC composition 400 will be applied, the composition of the fouling material, the age of the fouling material, the like, and combinations thereof.

In embodiments of the invention, wash composition 400 comprises 0.5 to 10 parts DMAC to 100 parts water by volume. In embodiments of the invention, wash composition 400 comprises 0.5 to 5 parts DMAC to 100 parts water by volume. In embodiments of the invention, wash composition includes 1 to 4 parts DMAC to 100 parts water by volume. In embodiments of the invention, wash composition includes 1 to 2 parts DMAC to 100 parts water by volume. In FIG. 4, wash composition 400 includes an effective amount of DMAC for removing fouling material from heat exchanger 402. Wash composition 400 can be stored in tank 401 and may be mixed in tank 401 to the effective concentration of DMAC or otherwise supplied to tank 401 at the effective concentration.

Depending on the composition of the fouling material to be removed from the processing equipment, it may be advantageous to carry out the cleaning process at a particular temperature (e.g., a temperature at which solubilization of the fouling material by DMAC is most effective). Thus, in embodiments of the invention, preparing wash composition 400 may involve bringing it to a particular temperature prior to applying it in the cleaning process. For example, method 301 may include heating or cooling wash composition 400 to a particular temperature prior to applying wash composition 400 to heat exchanger 402. Implementing this may involve system 40 having heating/cooling equipment 405 for heating or cooling wash composition 400 to the particular temperature prior to wash composition 400 being applied to the fouling material on heat exchanger 402. In embodiments of the invention, wash composition 400 may be heated or cooled such that it has a temperature in the range of 120 to 180° C. and the fouling removing process may be carried out at a temperature in the range of 120 to 180° C.

It should be noted that instead of heating or cooling wash composition 400 to achieve a particular temperature for carrying out the cleaning process, heat exchanger 402 may be heated or cooled to that particular temperature or other temperature. Thus, preparing the processing equipment, at block 300, may involve cooling heat exchanger 402 (or allowing it to cool) to the desired temperature (e.g., allowing it to cool to room temperature if it was at an elevated temperature in service). Likewise, preparing the processing equipment at block 300 may also include heating heat exchanger 402 to a desired temperature. In embodiments of the invention, preparing the processing equipment at block 300 may include heating or cooling the processing equipment to a temperature range of 110 to 200° C., 120 to 180° C., or 130 to 170° C.

After heat exchanger 402 and wash composition 400 have been prepared for the fouling material removal process, at block 302, tank 401 may be connected to heat exchanger 402 such that they are in fluid communication with each other. Thus, at block 303, pump 403 pumps wash composition 400 from tank 401 to heat exchanger 402. Wash composition 400 may be allowed to fill spaces adjacent to fouling material in heat exchanger 402 such that wash composition 400 (and in particular its component DMAC) contacts the fouling material in heat exchanger 402. Thus, block 303 involves applying a composition comprising DMAC to fouling material deposited on the processing equipment. In this way, wash composition 400 is able to solubilize fouling material in heat exchanger 402.

After wash composition 400 contacts the fouling material in heat exchanger 402, it may be pumped back to tank 401. The pumping from tank 401 to heat exchanger 402 and then back to tank 401 may be for a period sufficient to solubilize and wash fouling material from heat exchanger 402. In other words, wash composition 400 is used to flush heat exchanger 402 for a period to remove fouling material.

It should be noted that, in embodiments of the invention, heat exchanger 402 instead of or in addition to being subjected to flushing (recirculation of wash composition 400) may include filling the spaces ("flooding") in heat exchanger 402 with wash composition 400 and allowing wash composition 400 to stand (without recirculation) for a period. In that period, wash composition 400 solubilizes fouling material and removes at least some of the fouling material. After the period, wash composition 400 is removed from heat exchanger 402.

The period for flushing and/or flooding may depend on a variety of factors such as the type of processing equipment being cleaned, how wash composition 400 will be applied, the composition of the fouling material, the age of the fouling material, and the like, and combinations thereof. In embodiments of the invention, a period that is effective in wash composition 400 removing fouling material may be in the range of 30 minutes to 1 hour, or 1 hour to 2 hours, or 3 hours to 4 hours, or four hours to five hours, or six hours to seven hours, or eight hours to nine hours, or ten hours to eleven hours, or eleven hours to twelve hours, or 30 minutes to twelve hours, or longer periods of time.

In embodiments of the invention, the return line from heat exchanger 402 to tank 401 may have filter 404 to remove displaced fouling material that has not been completely solubilized. After being flushed, heat exchanger 402 may be prepared for return to service, at block 304. This may involve flushing heat exchanger 402 with water to remove, or reduce the amount of, wash composition 400 in heat exchanger 402. At block 305, heat exchanger 402 may be returned to service by reconnecting it to the dilution steam system.

Once back in service, one or more process parameters may be monitored, at block 306, to determine when fouling material should be again removed from heat exchanger 402 by the application of wash composition 400. Such process conditions that may be monitored are the temperature change across heat exchanger 402 ($\Delta T$) and/or pressure change across heat exchanger 402 ($\Delta P$). When the temperature change is sufficiently low or the pressure change is sufficiently high, that may indicate fouling material has built up to unacceptable levels and heat exchanger 402 should be cleaned. In embodiments of the invention, the monitoring of one or more process parameters may be used to determine the concentration of DMAC in the composition to be used for removal of fouling material.

At block 307, therefore, it is determined whether the temperature change across the heat exchanger 402 has reached a pre-determined level and/or pressure change across the heat exchanger 402 has reached a pre-determined level. If $\Delta T$ and/or $\Delta P$ have not reached a pre-determined limit, block 308 provides that no action is taken with respect to cleaning of heat exchanger 402. If $\Delta T$ and/or $\Delta P$ have reached a pre-determined limit, method 30 may return to block 300 to restart the method for heat exchanger 402.

Instead of or in addition to monitoring a process parameter to determine when to repeat the cleaning process, embodiments of the invention may include a set period between the implementation of fouling material removal processes for one or more pieces of equipment. Thus, the set period may remain substantially the same between fouling material removal processes, except when something abnormal occurs in the process in which the equipment is used. The period may vary from equipment to equipment, as the fouling material build up varies depending on the equipment.

In embodiments of the invention, the processing equipment (e.g., heat exchanger 402) may be taken out of service and presented in a way such that wash composition 400 can be applied to the areas of the processing equipment on which the fouling material is deposited. For example, heat exchanger 402 may be dismantled by pulling the tube bundle to get access to fouling material on the heat exchange equipment's tube side or shell side.

When embodiments of the invention include dismantling, instead of flushing at block 303 as described above, block 303 (applying wash composition 400) may include spraying wash composition 400 on the fouling material. After spraying wash composition 400 on the fouling material, wash composition 400 may be allowed to act on the fouling material (solubilizing it) for a particular period. In embodiments of the invention, the period may be in the range of 30 minutes to 1 hour, or 1 hour to 2 hours, or 3 hours to 4 hours, or four hours to five hours, or six hours to seven hours, or eight hours to nine hours, or ten hours to eleven hours, or eleven hours to twelve hours or 30 minutes to twelve hours, or longer periods of time. When block 300 involves dismantling heat exchanger 402 and block 303 involves spraying, method 30 may not involve block 302. In such methods that involve spraying, the equipment that is used to spray wash composition 400 on fouling material of heat exchanger 402 may include a high velocity washer ("pressure washer").

Once sufficient time has passed to allow wash composition 400 to act on the fouling material and at least partially solubilize the fouling material, a mechanical action for removing any unsolubilized fouling material from the processing equipment may be implemented. The mechanical action may involve rodding, scraping, power washing, and combinations thereof.

Alternatively or additionally, in embodiments of the invention, instead of flushing at block 303, block 303 may include brushing the composition onto the fouling material. After brushing wash composition 400 onto the fouling material, wash composition 400 may be allowed to act onto the fouling material (solubilizing it) for a particular period. In embodiments of the invention the period may be in the range of 30 minutes to 1 hour, or 1 hour to 2 hours, or 3 hours to 4 hours, or four hours to five hours, or six hours to seven hours, or eight hours to nine hours, or ten hours to eleven hours, or eleven hours to twelve hours, or 30 minutes to twelve hours, or longer periods of time. When block 300 involves dismantling heat exchanger 402 and block 303 involves brushing, method 30 may not involve block 302. In such systems that involve brushing, a brush may be used to apply wash composition 400 to fouling material of heat exchanger 402. As described above, once the fouling material is sufficiently solubilized, the cleaning process may include mechanical cleaning processes to remove unsolubilized fouling material.

In addition to, or as an alternative to the method described in FIG. 3, in embodiments of the invention, the DMAC wash composition can be dosed to the processing equipment (e.g. a dilution steam system). The DMAC wash composition can be dosed continuously or intermittently into the processing equipment. In certain aspects, the dosing of the DMAC wash composition may be performed to mitigate formation of the fouling material deposits in the processing equipment when the processing equipment is in operation. In this way, the operating time of the processing equipment between applications of the wash composition may be increased. Further, in embodiments of the invention, it may be advantageous use a DMAC wash composition that include 0.1 to 2 parts DMAC to 100 parts water by volume so as to not affect separation of the water/pyrolysis gasoline emulsion in the quench water settler or the quench water tower. Therefore, in embodiments of the invention, the DMAC wash composition can be dosed to the dilution steam system by adding the DMAC wash composition, continuously or intermittently, to the feed of a dilution steam system. Through the process of dosing DMAC, the concentration of DMAC in the dilution steam system feed can be maintained at 0.1 to 2 parts DMAC to 100 parts water by volume. In this way, the DMAC wash composition may not affect phase separation of the emulsion in the quench water tower of the dilution steam system. In certain aspects, the dilution steam system may be a dilution steam system of a steam cracker.

An intermittent cleaning of the dilution steam system with DMAC (e.g., as described above with respect to method 30) will allow recovery of heat exchanger capacity (which saves energy) and increases dilution steam system/dilution steam generator run length.

Although embodiments of the present invention have been described with reference to blocks of FIG. 3, it should be appreciated that operation of the present invention is not limited to the particular blocks and/or the particular order of the blocks illustrated in FIG. 3. Accordingly, embodiments of the invention may provide functionality as described herein using various steps in a sequence different than that of FIG. 3.

EXAMPLES

The present invention will be described in greater detail by way of specific examples. The following examples are offered for illustrative purposes only, and are not intended to limit the invention in any manner. Those of skill in the art will readily recognize a variety of noncritical parameters, which can be changed or modified to yield essentially the same results.

Example 1

Solubility of Process Water Stripper Sample in Different Concentrations of N,N Dimethylacetamide)

N,N dimethylacetamide was tested to illustrate that it can be used in removing fouling material from dilution steam system equipment. The test included taking a sample from a bottom pump of a process water stripper of a dilution steam system involved in the production of ethylene (process water stripper sample). A portion of the fouling from the process water stripper sample was introduced into (1) a 100% vol. of N,N dimethylacetamide, (2) water (0% vol. N,N dimethylacetamide), (3) a 2% vol. N,N dimethylacetamide/98% vol. water solution, and (4) a 10% vol. N,N dimethylacetamide/90% vol. water solution. Example 1 was performed at room temperature (approximately 20° C. to 30° C.).

Figure 1:
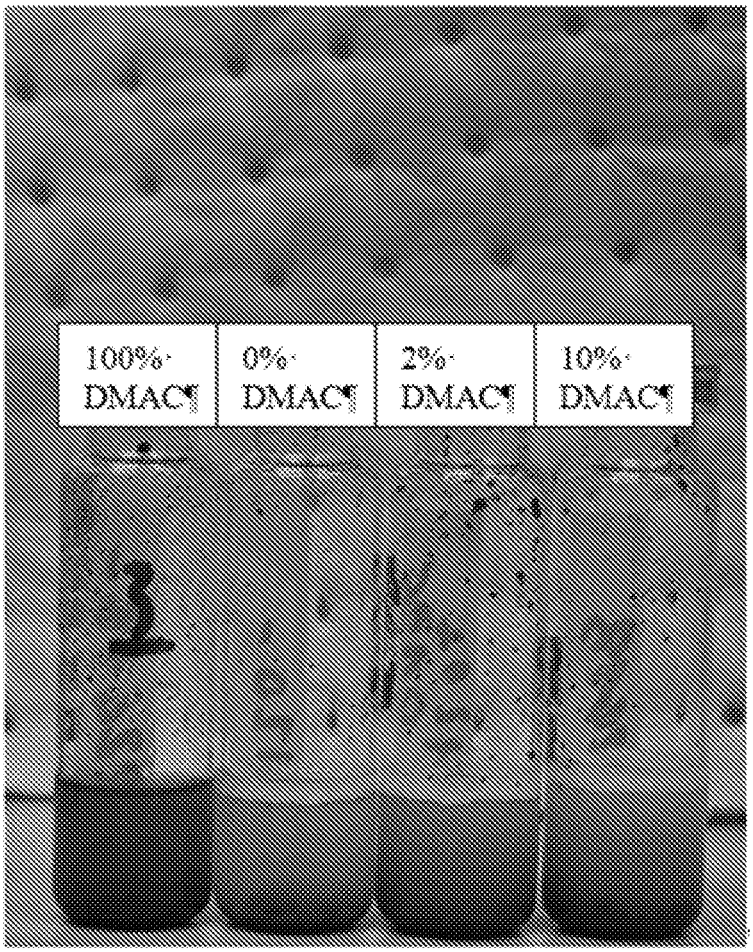
FIG. 1 shows results of a test (Example 1) to demonstrate the effectiveness of different concentrations of DMAC in solubilizing a first type of fouling material.

FIG. 1 shows results of the tests to demonstrate the effectiveness of different concentrations of DMAC in solubilizing the process water stripper sample. FIG. 1 shows that in a solution of 2% vol. N,N dimethylacetamide to 98% vol. water solution, the process water stripper sample is more soluble and more mobile than in water (i.e., 0% DMAC). The 10% vol. N,N dimethylacetamide/90% vol. water solution showed more solubilization of process water stripper sample than the 2% vol. N,N dimethylacetamide to 98% vol. water solution. Likewise, the 100% vol. of N,N dimethylacetamide showed more solubilization of process water stripper sample than the 10% vol. N,N dimethylacetamide to 90% vol. water solution.

Based on the foregoing, it can be concluded that DMAC is able to mobilize and displace fouling material that form within the dilution steam system and particularly within a process water stripper. It should be noted that the process water stripper sample is a "young" type of fouling material, that is, it has not been deposited for a very long time because fouling material is frequently removed from the process water stripper pump's filters. Because the process water stripper fouling material is young, it is poorly crosslinked.

Example 2

Solubility of Heat Exchanger Sample in Different Concentrations of N,N Dimethylacetamide N,N dimethylacetamide was tested to illustrate that it can be used in removing fouling material from dilution steam system equipment. The test included taking samples from heat exchanger of a dilution steam system involved in the production of ethylene (heat exchanger sample). A portion of heat exchanger sample was introduced into (1) a 100% vol. of N,N dimethylacetamide, (2) a 4% vol. N,N dimethylacetamide/96% vol. water solution, and (3) water (0% vol. N,N dimethylacetamide). Example 2 was performed at room temperature. The heat exchanger sample is older than the process water stripper sample of Example 1 (i.e., the heat exchanger sample of Example 2 had been deposited for a longer period than the process water stripper sample of Example 1). Thus, heat exchanger sample is a more cross-linked fouling than process water stripper fouling material sample.

Figure 2:
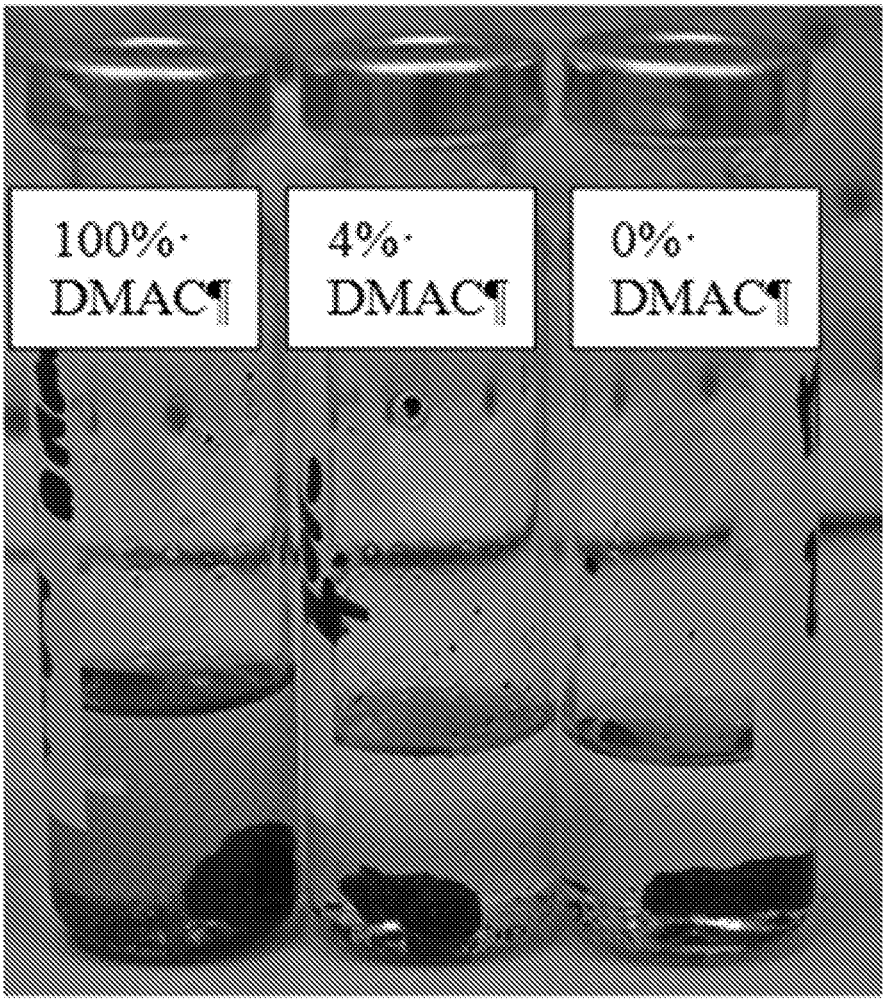
FIG. 2 shows results of a test (Example 2) to demonstrate the effectiveness of different concentrations of DMAC in solubilizing a second type of fouling material.

FIG. 2 shows results of the test to demonstrate the effectiveness of different concentrations of DMAC in solubilizing the heat exchanger sample. FIG. 2 shows that 100% vol. N,N dimethylacetamide solubilizes the heat exchanger sample. However, the 4% vol. N,N dimethylacetamide/96% vol. water solution was observed not to solubilize the heat exchanger sample. The inability of the N,N dimethylacetamide to dissolve the heat exchanger sample at this lower concentration may be as a result of the heat exchanger sample fouling material being heavily cross-linked fouling material. Likewise, water (0% vol. N,N dimethylacetamide) was observed not to solubilize the heat exchanger sample.

The effect of N,N dimethylacetamide on water/pyrolysis gasoline separation was also studied. That is, the study determined whether N,N dimethylacetamide affects the stability of the water/pyrolysis gasoline emulsion in the dilution steam system. From that study, it was found that N,N dimethylacetamide affects the separation of water/pyrolysis gasoline if N,N dimethylacetamide was above a concentration of 1-2% vol. Full demixing times and turbidity slightly increased after 2% vol. (e.g., some samples had a demixing time of from 10 sec to 20 sec and turbidity from 270 to 340 NTU).

In view of the data of Example 1 and Example 2, the use of N,N dimethylacetamide may be used as an intermittent wash-composition to remove fouling material that deposits on equipment of dilution steam systems.

It is claimed:

1. A method of removing material that fouls processing equipment, the method comprising applying a composition comprising N,N-dimethylacetamide (DMAC) to fouling material deposited on the processing equipment to solubilize and remove the fouling material from the processing equipment.

2. The method of claim 1, wherein the processing equipment is used in production of ethylene.

3. The method of claim 1, wherein the fouling material comprises polystyrene or other aromatic fouling material.

4. The method of claim 3, wherein the processing equipment comprises a dilution steam system used in production of ethylene.

5. The method of claim 4, wherein the processing equipment is a quench water tower, a quench water settler, a quench water loop, a process water stripper, a heat exchanger, or a pump.

6. The method of claim 4, further comprising continuously or intermittently dosing the composition to a feed of the dilution steam system before applying the composition to the fouling material.

7. The method of claim 1, wherein the composition is applied by flushing the processing equipment with the composition, spraying the processing equipment with the composition, brushing the processing equipment with the composition, or adding the composition to a dilution steam generator feed.

8. The method of claim 7, wherein the applying of the composition comprises spraying the composition on the fouling material.

9. The method of claim 1, wherein the composition is applied to the processing equipment intermittently.

10. The method of claim 9, wherein intermittent application comprises substantially the same period of time between applications of the composition.

11. The method of claim 9, wherein applying the composition intermittently comprises:

applying the composition in a first cleaning process;

monitoring a process parameter in a quench water tower loop of a dilution steam system in use for production of ethylene; and when a particular criterion is met regarding the monitored process parameter, applying the composition in a second cleaning process.

12. The method of claim 11, wherein the percentage of DMAC in the composition is varied depending on which equipment in the quench water tower loop the composition is being applied.

13. The method of claim 11, wherein information from the monitoring of the process parameter is used to establish the percentage of DMAC in the composition.

14. The method of claim 1, wherein the composition comprises 0.5 to 10 parts DMAC to 100 parts water by volume.

15. The method of claim 14, wherein the composition comprises 0.5 to 5 parts DMAC to 100 parts water by volume.

16. The method of claim 1, further comprising, prior to applying the composition comprising DMAC, heating or cooling the processing equipment to a temperature effective for solubilization of the fouling material by the composition.

17. The method of claim 1, further comprising, prior to applying the composition comprising DMAC, heating the composition to a temperature effective for solubilization of the fouling material by the composition.

18. The method of claim 1, further comprising implementing a mechanical action for removing unsolubilized material after some of the fouling material has been solubilized.

19. The method of claim 18, wherein the mechanical action comprises rodding, scraping, or power washing.

20. The method of claim 1, wherein the applying of the composition comprises adding the composition to the dilution steam system.

* * * * *